US009091124B2

(12) United States Patent
Hashem et al.

(10) Patent No.: US 9,091,124 B2
(45) Date of Patent: Jul. 28, 2015

(54) WEAR AND BUCKLING RESISTANT DRILL PIPE

(75) Inventors: Ghazi J. Hashem, Seabrook, TX (US); John W. Kochera, Conroe, TX (US); Melissa Frilot, Houston, TX (US); Thomas M. Redlinger, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 684 days.

(21) Appl. No.: 13/278,403

(22) Filed: Oct. 21, 2011

(65) Prior Publication Data

US 2013/0098687 A1 Apr. 25, 2013

(51) Int. Cl.
*E21B 17/00* (2006.01)
*E21B 17/10* (2006.01)

(52) U.S. Cl.
CPC *E21B 17/00* (2013.01); *E21B 17/10* (2013.01)

(58) Field of Classification Search
CPC ..... E21B 17/10; E21B 17/006; E21B 17/00; E21B 17/02; E21B 17/021; E21B 43/103; E21B 43/106; E21B 19/24
USPC ..... 166/380, 242.1, 117.7; 175/57, 320; 285/32, 382.4, 382.5
See application file for complete search history.

(56) References Cited

U.S. PATENT DOCUMENTS 2,259,023 A 10/1941 Clark
2,295,873 A 9/1942 Stone
2,330,933 A * 10/1943 Terrell, Jr. ..... 166/243
3,067,593 A 12/1962 McCool
3,080,179 A 3/1963 Huntsinger
3,682,256 A 8/1972 Stuart
3,773,359 A 11/1973 Chance et al.
3,784,238 A 1/1974 Chance et al.
4,416,476 A 11/1983 Garrett
4,460,202 A 7/1984 Chance et al.
4,987,961 A * 1/1991 McNeely, Jr. ..... 175/320
5,148,876 A 9/1992 Wilson
5,165,491 A 11/1992 Wilson
5,332,049 A 7/1994 Tew
5,713,423 A 2/1998 Martin et al.
5,853,199 A 12/1998 Wilson
6,012,744 A 1/2000 Wilson et al.
6,352,107 B1 * 3/2002 Bennett et al. ..... 166/105
6,457,532 B1 * 10/2002 Simpson ..... 166/380
6,758,499 B1 7/2004 Belew et al.
7,040,422 B2 5/2006 Springer
7,182,160 B2 * 2/2007 Boulet ..... 175/320

(Continued)

OTHER PUBLICATIONS

RDT, "Wear Knot Drill Pipe Features and Benefits", www.rdt-usa.com.

(Continued)

*Primary Examiner* — Jennifer H Gay
*Assistant Examiner* — David Carroll
(74) *Attorney, Agent, or Firm* — Patterson & Sheridan LLP

(57) ABSTRACT

A drill pipe includes one or more sections which are strengthened, or their shape is altered, in order to improve the wear and buckle resistance of the drill pipe. The sections are strengthened using various hardening methods such as heat treatment processes and/or expansion techniques. A sleeve can also be applied to the strengthened portions. Surface enhancers, such as hardbanding, can be applied to the strengthened portions or the sleeve in order to provide abrasion resistance or to reduce friction.

39 Claims, 4 Drawing Sheets

(56) References Cited

U.S. PATENT DOCUMENTS

| | | | | |
|---|---|---|---|---|
| 7,487,840 | B2 | 2/2009 | Gammage et al. | |
| 7,810,573 | B2 * | 10/2010 | Baird | 166/378 |
| 7,814,996 | B2 | 10/2010 | Indrupskiy et al. | |
| 8,286,715 | B2 * | 10/2012 | Bailey et al. | 166/380 |
| 8,561,707 | B2 * | 10/2013 | Jin et al. | 166/380 |
| 2002/0185188 | A1 * | 12/2002 | Quigley et al. | 138/137 |
| 2008/0035328 | A1 * | 2/2008 | Hill et al. | 166/162 |
| 2009/0223200 | A1 * | 9/2009 | Kinert et al. | 59/84 |
| 2009/0321144 | A1 * | 12/2009 | Wyble et al. | 175/320 |
| 2010/0038404 | A1 | 2/2010 | Lingnau et al. | |
| 2010/0044110 | A1 * | 2/2010 | Bangru et al. | 175/61 |
| 2010/0230167 | A1 * | 9/2010 | Nichols et al. | 175/57 |
| 2012/0306199 | A1 * | 12/2012 | David | 285/333 |
| 2013/0056225 | A1 * | 3/2013 | Pabon et al. | 166/381 |
| 2013/0112481 | A1 * | 5/2013 | Wang | 175/57 |

OTHER PUBLICATIONS

RDT, "Wear Knot Drill Pipe Technical Description", www.rdt-usa.com.

WearSox, "Twin Wire ARC Thermal Spray Process", www.wearsox.com.

Attachment B: Sinusoidal Buckling and Countermeasures, "Special Downhole Tools to Improve Drillpipe Stiffness", K&M Technology Group, Drilling Design and Implementation for Extended Reach and Complex Wells, 3rd Edition, 2003, p. 126-131.

Canadian Office Action for Canadian Patent Applicaton No. 2791599, dated Jul. 3, 2014.

* cited by examiner

WEAR AND BUCKLING RESISTANT DRILL PIPE

FIELD OF THE INVENTION

The present invention relates generally to wellbore tubular and, more specifically, to a wear and buckle resistant drill pipe.

BACKGROUND

Drilling activity in hard and tight Shale formations has increased substantially in the last few years. The wells that are drilled in these formations are generally very deep and complex. They can be comprised of depths that may exceed 10,000 feet vertically and 10,000 feet in the lateral section of the well.

During the drilling operation of these wells, which may include, but are not limited to, tripping in and tripping out of the well, sliding, rotation, etc., the drill pipe is subjected to high compressive loads that could cause severe buckling of the drill pipe. The buckling could manifest itself as Helical Buckling in the vertical section and/or Sinusoidal Buckling in the lateral section. Sinusoidal buckling occurs when the axial force on a long column, in this case drill pipe, exceeds the critical buckling force and the pipe elastically deforms or bends and takes on a snake-like shape in the hole. Weight transfer is still possible during Sinusoidal Buckling, but is inefficient. Additional compressive loads cause Sinusoidal buckling to transition to Helical Buckling, and take on a corkscrew-like shape in the hole. As such, Helical Buckling is more severe and occurs after Sinusoidal buckling.

Helical Buckling may or may not cause plastic or permanent deformation of the pipe, depending upon the amount of axial compressive forces applied, although most buckling stresses are below the yield strength of the pipe. In its most severe form, Helical Bucking can result in Helical Lockup, which is when weight can no longer be transferred to the bit.

The critical buckling load of drill pipe is not only dependent on drilling conditions, such as drill pipe size and hole size, but also and more important is whether the wellbore is straight, horizontal, curving, or inclined. In highangle wells, the force of gravity pulls the drill string against the low side of the hole. This helps to support and constrain the pipe along its length, stabilizing the string and as a result, allowing the drill pipe to withstand higher axial loads before buckling.

Inversely, vertical sections are the most susceptible to buckling. Critical compression in the vertical section of the hole can result in buckling. In build sections, the bending forces exerted by the hole help the pipe to resist buckling. However, pipe will always buckle first in a straight section.

Buckling also causes an increase in drill pipe casing contact and wellbore drill pipe contact. Along with the increased contact, the drill pipe also sees increased side force due to buckling on these contact areas. The more weight applied at surface, the more the coiled pipe presses into the sides of the hole—which has lead many in the industry to support the belief that bucking causes excessive tube wear.

Buckling not only can damage the pipe, it can also negatively affect drilling operations. In slide drilling, for example, buckling may prevent the desired weight on bit because of an increase in drill string side loads to the point that weight cannot be efficiently transmitted to the bit. At the same time, side loads are increased by buckling of the drill pipe due to compressive loading, further exacerbating the problem.

Ultimately, due to the severe drilling environment in downhole wells, the useful life of the drill pipe is severely shortened. In addition to buckling, the drill pipe may exhibit severe abrasion on one side of the tool joint following the failure of the hardbanding, which will lead to wall thickness loss at the tool joint and/or washouts at the middle section of the tubes.

In view of the foregoing, there is a need in the art for a method by which the useful life of the drill pipe is extended against downhole abrasions and buckling, thereby providing a drill pipe having increased wear and buckle resistance.

SUMMARY OF THE INVENTION

Exemplary embodiments and methodologies of the present invention provide a drill pipe in which various sections of the pipe between the tool joints are strengthened, or the shape is altered, in order to improve the wear and buckle resistance of the drill pipe. In a first embodiment, at least one portion of the drill pipe undergoes a hardening process that results in that portion being strengthened. The hardening process can be, for example, a heat treatment, carburizing, nitriding, carbonitriding, flame hardening or chromizing process. In another embodiment, at least one portion of the drill pipe is expanded in order to strengthen that portion of the pipe. The shape of the expanded section can remain circular or be formed into some other sectional profile, such as a modified hexagonal or elliptical shape, which will strengthen the expanded portions of the drill pipe in order to improve erosion resistance and to reduce friction. In the alternative, a sleeve can be applied to the strengthened portion in which a surface enhancer could be applied to the surface of the sleeve or the sleeve surface itself can undergo the hardening process. Furthermore, a pipe can be inserted along the expanded portion and expanded along with the expanded portion, thus providing further strengthening to the drill pipe.

DESCRIPTION OF ILLUSTRATIVE EMBODIMENTS

Illustrative embodiments and related methodologies of the present invention are described below as they might be employed in a wear and buckle resistant drill pipe. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
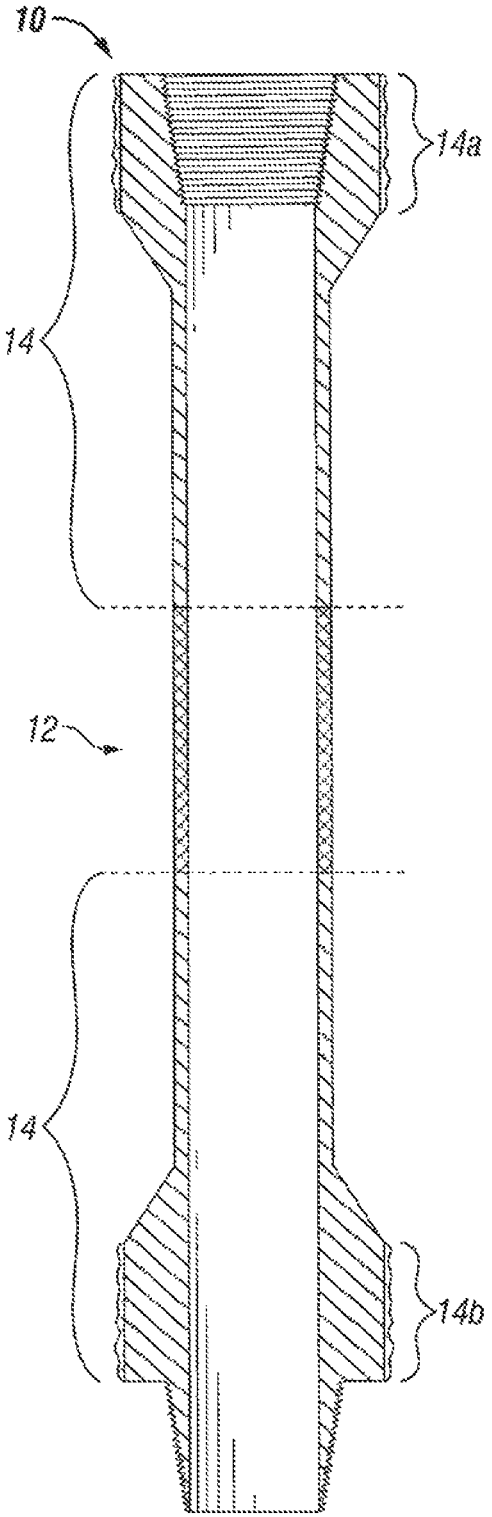
FIG. 1 illustrates a drill pipe having a hardened section according to an exemplary embodiment of the present invention.

FIG. 1 illustrates a drill pipe 10 according to an exemplary embodiment of the present invention. Drill pipe 10 comprises male and female ends and is made of steel, or some other suitable material, as understood in the art. In the present invention, however, a middle section 12, or a portion thereof, has been hardened using a hardening process. Such a hardening process can be, for example, a heat quenching and tempering, carburizing, nitriding, carbonitriding, flame hardening, or chromizing process whereby the middle section 12 is made into a hardened, higher strength material.

In this exemplary embodiment, section 12 has been quenched and tempered using an austenitizing temperature of roughly 1700 degrees Fahrenheit and a tempering temperature of roughly 1050 degrees Fahrenheit. However, those ordinarily skilled in the art having the benefit of this disclosure realize other temperatures and/or time periods may be utilized to achieve desired results. Also, the length of middle section 12 is between 5-15 feet in this exemplary embodiment. However, the length may be longer or shorter as would be understood by one ordinarily skilled in the art having the benefit of this disclosure.

Drill pipe 10 also comprises sections 14 located adjacent to section 12 which are not hardened as described above in order to increase the strength of section 12. As a result, the portion of sections 14 adjacent to the tool joints remain at the original lower strength of the steel (or other material) which allows for a more reliable slip engagement. (If the portions of section 14 adjacent to the tool joints were hardened, the possibility of failure due to the slips (not shown) engaging the hardened high strength area would be greatly increased because the hardened area would be more susceptible to cracking). Also in this exemplary embodiment, a surface enhancer, such as hardbanding for example, is applied to sections 14*a* and 14*b* using any suitable method as would be readily understood by one ordinarily skilled in the art having the benefit of this disclosure. Furthermore, any suitable hardbanding material such as, but not limited to, tungsten carbides or chromium alloy hardbanding, may be utilized. In addition, a surface enhancer may also be applied to the outer surface of middle section 12. Accordingly, as a result of the described hardening process, middle section 12 of drill pipe 10, which is subjected to abrasion during downhole operations, will resist wear and show less erosion at the area of contact with the cased and open hole.

Figure 2:
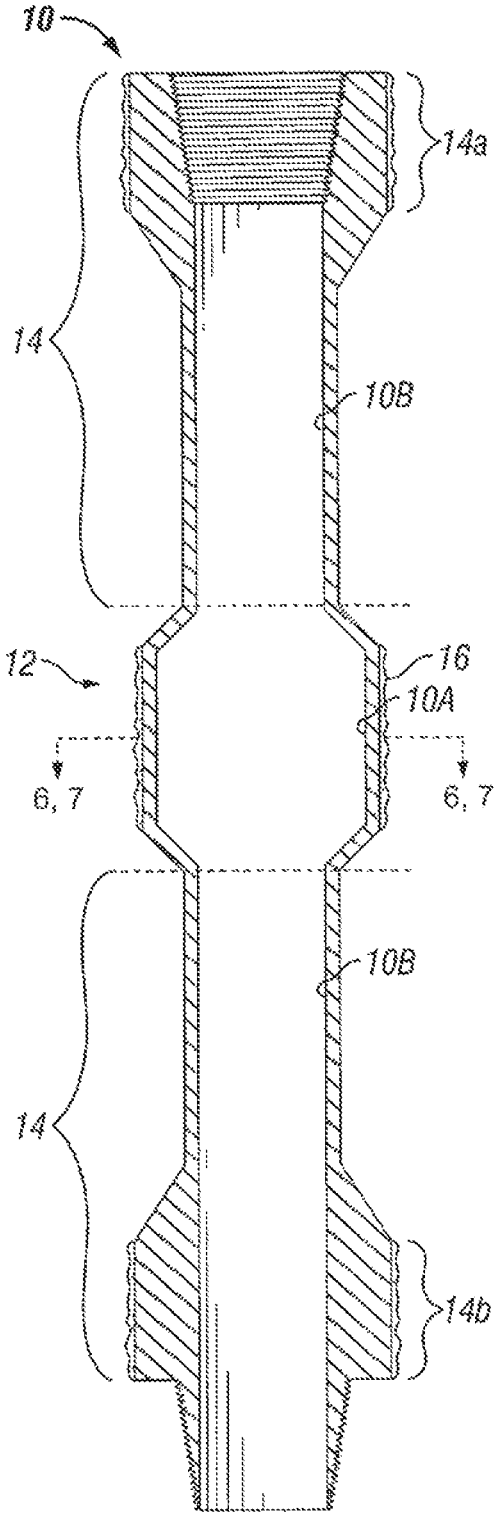
FIG. 2 illustrates a drill pipe having an expanded section according to an exemplary embodiment of the present invention.

FIG. 2 illustrates another drill pipe 10 according to an alternative exemplary embodiment of the present invention. Here, middle section 12, or a portion thereof, is treated using a tubular expansion technique, as understood in the art. An exemplary expansion technique is the technique disclosed in U.S. Pat. No. 6,457,532, entitled "PROCEDURES AND EQUIPMENT FOR PROFILING AND JOINTING OF PIPES," issued on Oct. 1, 2002, naming Neil Simpson as inventor, which is owned by the Assignee of the present invention, Weatherford/Lamb, Inc., of Houston, Tex., and is hereby incorporated by reference in its entirety. In this embodiment the outer diameter of section 12 is expanded in the range of 15-20%, although other ranges may be utilized as desired. In this embodiment, the radial expansion technique results in the inner diameter 10A of expanded section 16 is larger than the inner diameter 10B of the remaining portion of drill pipe 10.

Figure 6:
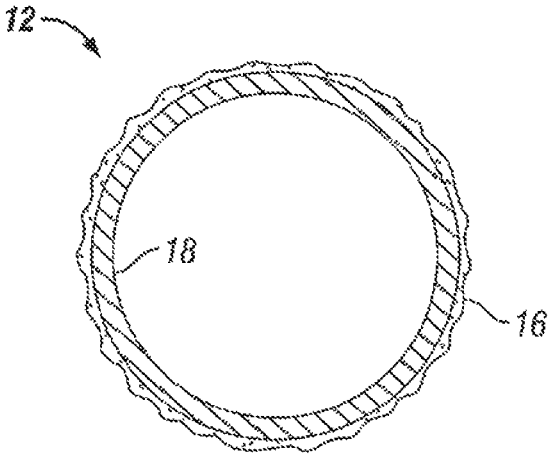
FIGS. 6 and 7 illustrate the profile of a drill pipe along lines 6 and 7 of FIG. 2, respectively, according to an exemplary embodiment of the present invention.
Figure 7:
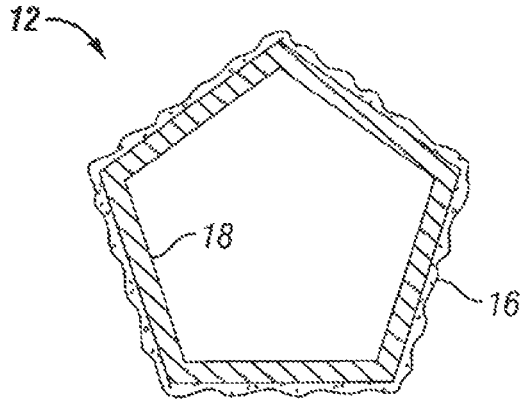

The yield strength of section 12 will increase to a degree proportional to the amount of expansion, as would be understood by one ordinarily skilled in the art having the benefit of this disclosure. Moreover, profile 18 of section 12 may be expanded in a variety of shapes, such as a circular or pentagon shape, as illustrated in FIGS. 6 and 7, respectively. By expanding section 12, the stiffness of the material along section 12 is increased, thereby also increasing the wear and buckle resistance of drill pipe 10.

After section 12 is expanded, it may be hardened as described above in relation to the exemplary embodiment of FIG. 1. In addition, surface enhancer 16 may be applied to the outer surface of section 12. As previously described, surface enhancer 16 may be a hardbanding material. However, note that in some embodiments, downhole conditions may not necessitate, or it may not be desired, to harden section 12 or to apply surface enhancer 16 in order to achieve additional strengthening, as would be readily understood by one ordinarily skilled in the art having the benefit of this disclosure. Moreover, surface enhancer 16 may be applied to the outer surface of section 12 in a variety of patterns, such as lengthwise along the hexagonal asperities, a circular corkscrew-type pattern around section 12, or a dotted pattern, as would also be understood by one ordinarily skilled in the art having the benefit of this disclosure. If a helical cork-screw pattern is utilized on the expanded section 12, it would also assist in the removal of cuttings as would be understood by one ordinarily skilled in the art having the benefit of this disclosure. Accordingly, the wear and buckle resistance of drill pipe 10 is greatly increased.

Figure 3:
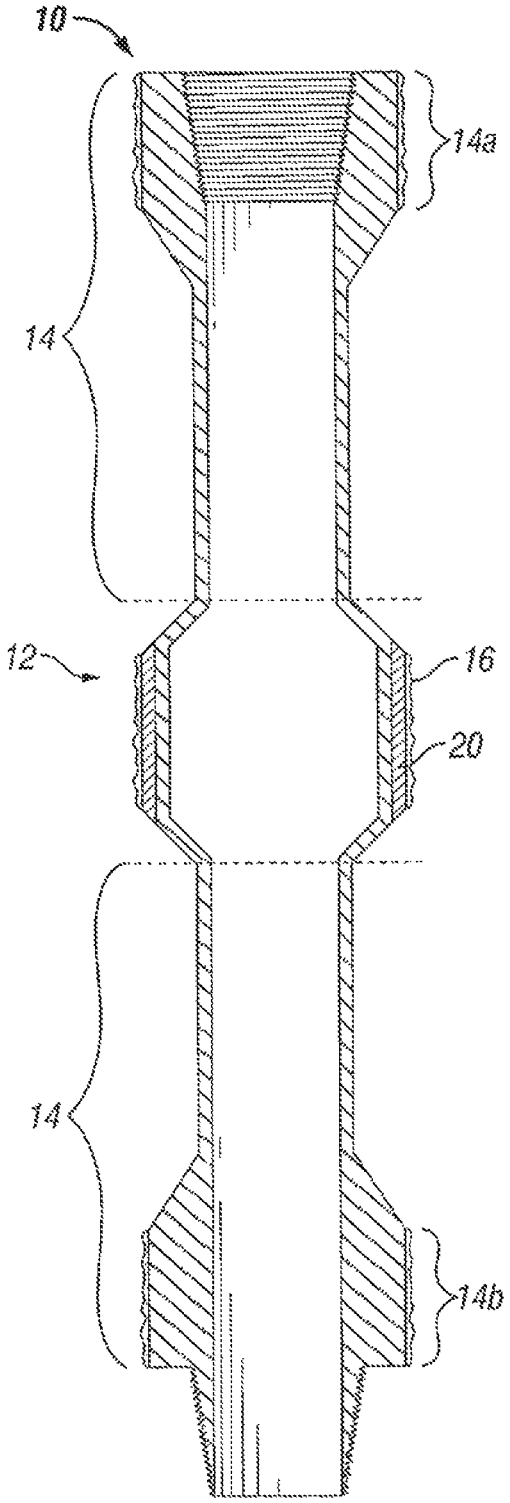
FIG. 3 illustrates a drill pipe having an expanded section and a sleeve according to an exemplary embodiment of the present invention.
Figure 3A:
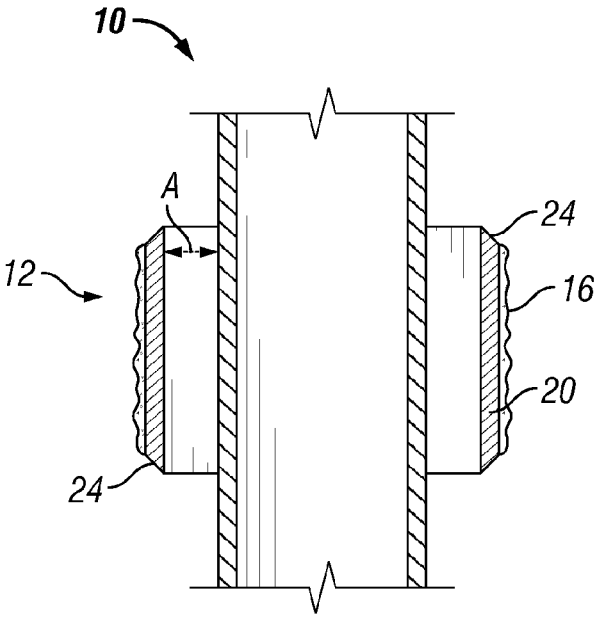
FIG. 3A illustrates an exploded view of FIG. 3 before expansion takes place.

Referring to FIG. 3, an alternative exemplary embodiment of drill pipe 10 is illustrated. Here, before middle section 12 of drill pipe 10 is expanded, a sleeve 20 is placed over middle section 12, as illustrated in FIG. 3A. In this embodiment, sleeve 20 approximates the length of middle section 12 (section to be expanded) and may be a seamless or welded tube, for example, made of any suitable wear resistant material. The inner diameter of the length of sleeve 20 approximates that of the outside diameter of middle section 12 of drill pipe 10.

As can been seen in FIG. 3A, a gap A is present between the outer surface of middle section 12 of the inner surface of sleeve 20. Thereafter, middle section 12 is expanded using a technique previously described above in relation to FIG. 2. Here, middle section 12 is expanded until it meshes, or comes into contact, with sleeve 20, resulting in the configuration illustrated in FIG. 3 (gap A is no longer present). Moreover, a sleeve 24 comprises tapered edge 24 at both its top and lower ends in order to reduce friction during drilling operations.

Sleeve 20 is then be fastened to middle section 12 using any suitable method such as, for example, shrink fitting, welding, epoxy, etc. Moreover, surface enhancer 16 may be applied to the outer surface of sleeve 20. Here, surface enhancer 16 may be, for example, hardbanding, titanium, carbon fiber, induced hardening material, or some other friction and/or abrasion reducing material or mechanism. In the alternative, sleeve 20 itself may be made of a variety of materials which reduce friction and erosion, such as, for example, titanium or carbon fiber for example. In addition, the outer surface of sleeve 20 may be hardened using one of the hardening processes described herein. Accordingly, through use of sleeve 20, the wear and buckle resistance of drill pipe 10 is greatly enhanced.

Figure 4:
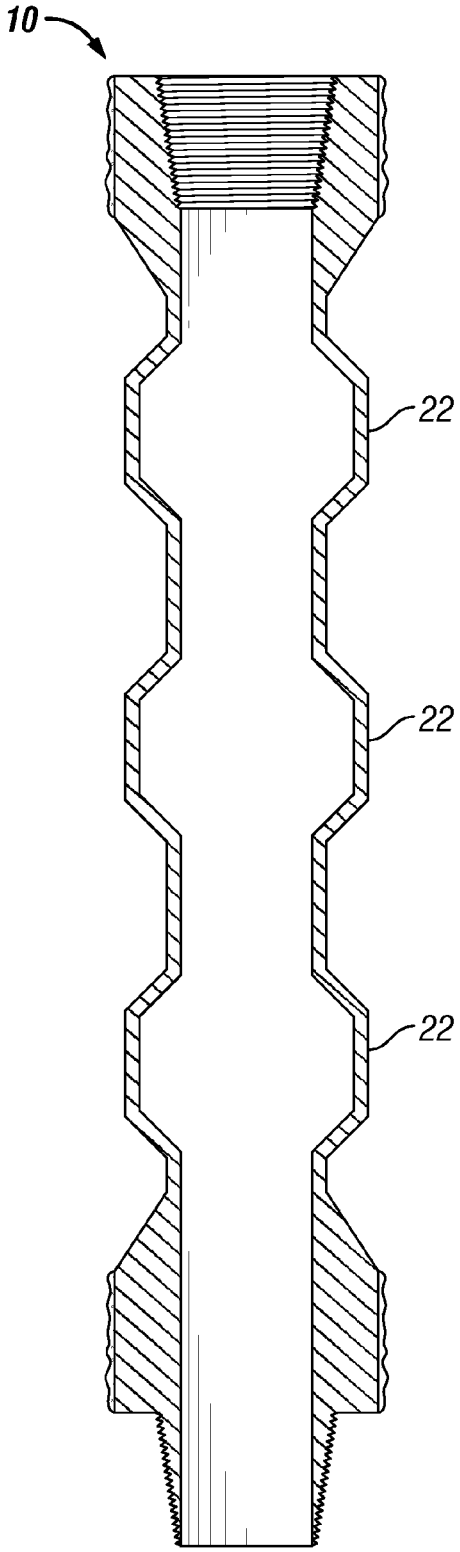
FIG. 4 illustrates a drill pipe having a plurality of strengthened sections according to an exemplary embodiment of the present invention.

FIG. 4 illustrates yet another exemplary embodiment of drill pipe 10. Here, instead of modifying middle section 12 only as described in the embodiments above, a plurality of sections 22 along drill pipe 10 have been modified. Although illustrated for simplicity, each section 22 may have been modified using one or more of the techniques described above. For example, one section 22 may have been hardened, while another was expanded, and the other section 22 was expanded and a sleeve was applied. Therefore, one ordinarily skilled in the art having the benefit of this disclosure realizes there are multiple combinations of techniques taught herein that could be utilized on any given drill pipe.

Figure 5A:
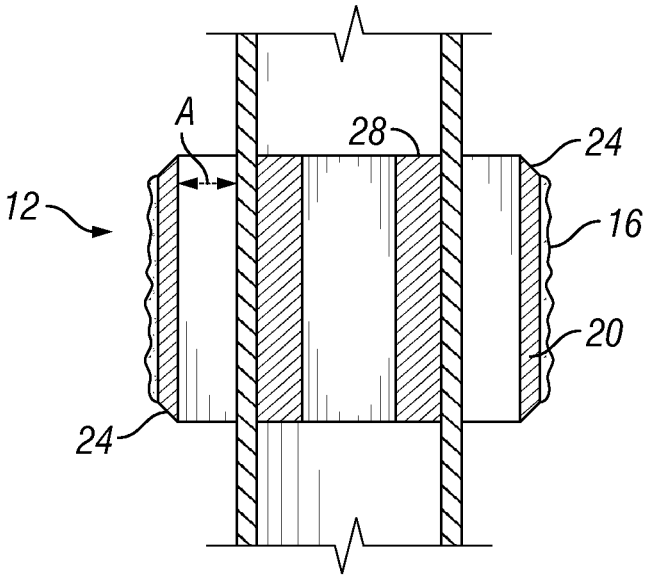
FIGS. 5A & 5B illustrate exploded views of the expanded section having an internal pipe prior to and after expansion, respectively, according to an exemplary embodiment of the present invention.
Figure 5B:
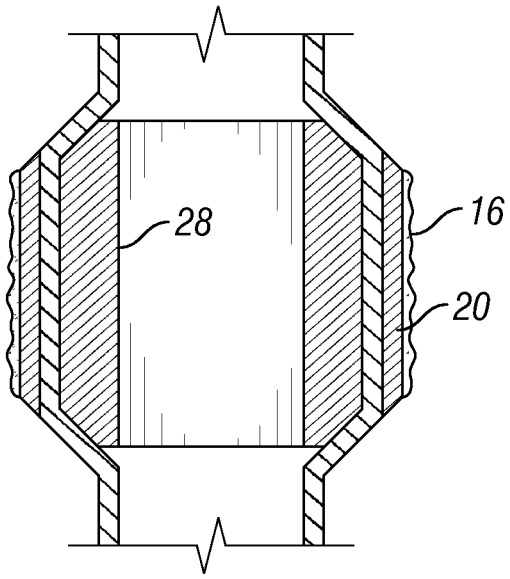

FIGS. 5A and 5B illustrate an alternative exemplary embodiment of the present invention. Here, drill pipe 10 is identical to those described in relation to FIGS. 2 and 3 above, however, with an internal pipe 28 added. Pipe 28 is a circular or non-circular pipe that has a length that equals, or nearly equals, the length of middle section 12. Pipe 28 is inserted into drill pipe 10 before expansion occurs. Once inserted, pipe 28, along with middle section 12 of drill pipe 10 is expanded using techniques mentioned above. The thickness of internal pipe 28 is adequate such when it is expanded, the inner diameter of pipe 28 approximates that of the original inner diameter (10B) of drill pipe 10. Accordingly, after expansion, drill pipe 10 will have a nearly identical inner diameter throughout its entire length. In addition, the addition of internal pipe 28 will provide a greater wall thickness at middle section 12 which further enhances the buckle resistance of drill pipe 10.

An exemplary embodiment of the present invention provides a drill pipe comprising a first joint located on an upper end of the drill pipe; a second joint located on a lower end of the drill pipe; a tubular body extending between the first and second joints, the tubular body comprising: an upper section extending beneath the first joint; a middle section extending beneath the upper section; and a lower section extending beneath the middle section, wherein a portion of the middle section of the tubular body comprises hardened material, while the first and second joints and the upper and lower sections of the drill pipe comprise a softer material, the hardened material being formed as a result of the middle section undergoing a hardening process, thereby resulting in a hardened middle section. In another exemplary embodiment, the hardening process comprises at least one of a heat treatment, carburizing, nitriding, carbonitriding, flame hardening or chromizing process.

Yet another exemplary embodiment comprises a surface enhancer on an outer surface of the hardened middle section. In another, the surface enhancer is at least one of a friction-reducing material or an abrasion-resistant material. In yet another, a plurality of portions of the upper, middle, and lower sections of the drill pipe also comprise hardened material which is formed through the use of the hardening process.

Another exemplary embodiment of the present invention provides a drill pipe comprising: a first joint located on an upper end of the drill pipe; a second joint located on a lower end of the drill pipe; a tubular body extending between the first and second joints, the tubular body comprising: an upper section extending beneath the first joint; a middle section extending beneath the upper section; and a lower section extending beneath the middle section, wherein the middle section of the tubular body comprises an expanded section in which an inner diameter of the expanded section is larger than an inner diameter of the upper and lower sections of the drill pipe. Another embodiment comprises a surface enhancer on an outer diameter of the expanded section. In yet another, the expanded section comprises at least one of a circular or non-circular shape.

In another embodiment, the expanded section comprises a hardened material which has undergone a hardening process, the hardening process being at least one of a heat treatment, carburizing, nitriding, carbonitriding, flame hardening or chromizing process. In yet another embodiment, a plurality of portions of the upper, middle, and lower sections of the drill pipe also comprise expanded sections. In another exemplary embodiment, the drill pipe further comprises a sleeve fixed atop an outer surface of the expanded section. In another, the sleeve comprises a surface enhancer on an outer surface of the sleeve. In yet another, the surface enhancer comprises at least one of a friction-reducing or abrasion-resistant material. In another, the outer surface of the sleeve comprises a hardened material which has undergone a hardening process. In yet another, an internal pipe is positioned along the inner diameter of the expanded section, an inner diameter of the internal pipe being substantially flush with the inner diameters of the upper and lower sections of the drill pipe.

An exemplary methodology of the present invention provides a method of manufacturing a drill pipe, the method comprising the steps of: (a) providing a first joint located on an upper end of the drill pipe; (b) providing a second joint located on a lower end of the drill pipe; and (c) providing a tubular body extending between the first and second joints, the tubular body comprising: an upper section extending beneath the first joint; a middle section extending beneath the upper section; and a lower section extending beneath the middle section, wherein a portion of the middle section of the tubular body comprises hardened material, while the first and second joints and the upper and lower sections of the drill pipe comprise a softer material, the hardened material being formed as a result of the middle section undergoing a hardening process, thereby resulting in a hardened middle section. In another, the hardening process comprises at least one of a heat treatment, carburizing, nitriding, carbonitriding, flame hardening or chromizing process. Yet another methodology further comprises the step of applying a surface enhancer on an outer surface of the hardened middle section.

In another methodology, the surface enhancer is at least one of a friction-reducing material or a abrasion-resistant material. In yet another, the method further comprises the step of applying the hardening process to a plurality of portions of the upper, middle, and lower sections of the drill pipe in order to transform the plurality of portions into hardened material.

Another exemplary methodology of the present invention provides a method of manufacturing a drill pipe, the method comprising the steps of: (a) providing a first joint located on an upper end of the drill pipe; (b) providing a second joint located on a lower end of the drill pipe; and (c) providing a tubular body extending between the first and second joints, the tubular body comprising: an upper section extending beneath the first joint; a middle section extending beneath the upper section; and a lower section extending beneath the middle section, wherein the middle section of the tubular body comprises an expanded section in which an inner diameter of the expanded section is larger than an inner diameter of the upper and lower sections of the drill pipe. In another methodology, the method further comprises the step of providing a surface enhancer on an outer diameter of the expanded section. In yet another, the expanded section comprises at least one of a circular or non-circular shape. In another, the method further comprises the step of applying a hardening process to the expanded section, thereby transforming the expanded section into a hardened material.

In another exemplary method, the hardening process is at least one of a heat treatment, carburizing, nitriding, carbonitriding, flame hardening or chromizing process. In yet another, the method further comprises the step of expanding a plurality of portions of the upper, middle, and lower sections of the drill pipe. In another, the method further comprises the step of affixing a sleeve atop an outer surface of the expanded section. In yet another, the method further comprises the step of applying a surface enhancer on an outer surface of the sleeve. In another, the surface enhancer comprises at least one of a friction-reducing or abrasion-resistant material. In yet another, the method further comprises the step of applying the hardening process to the outer surface of the sleeve, thereby resulting in a hardened sleeve. In another, the method further comprises the steps of: providing an internal pipe positioned along the inner diameter of the expanded section; and expanding the internal pipe adjacent the expanded section, wherein an inner diameter of the internal pipe is substantially flush with the inner diameters of the upper and lower sections of the drill pipe.

Another exemplary methodology of the present invention provides a method of manufacturing a drill pipe, the method comprising the steps of: (a) providing a first joint located on an upper end of the drill pipe; (b) providing a second joint located on a lower end of the drill pipe; (c) providing a tubular body extending between the first and second joints, the tubular being made of a material having a predetermined hardness; and (d) applying a hardening process to at least one portion of the tubular body, thereby resulting in a material which is harder than the material having the predetermined hardness. In another methodology, the method further comprises the step of applying a sleeve atop the at least one portion of the tubular body. In another, the method further comprises the step of: applying a surface enhancer to an outer surface of the at least one portion of the tubular body; or applying the surface enhancer to an outer surface of a sleeve which has been affixed atop the at least one portion of the tubular body. In another, the method further comprises the step of applying the hardening process to the sleeve.

Another exemplary methodology of the present invention provides a method of manufacturing a drill pipe, the method comprising the steps of: (a) providing a first joint located on an upper end of the drill pipe; (b) providing a second joint located on a lower end of the drill pipe, a tubular body extending between the first and second joints; and (c) expanding at least one portion of the tubular body. In another, the method further comprises the step of performing a hardening process on the expanded portion of the tubular body. In another, the hardening process is at least one of a heat treatment, carburizing, nitriding, carbonitriding, flame hardening or chromizing process. In yet another, the method further comprises the step of affixing a sleeve atop the at least one expanded portion.

In another, the method further comprises the step of applying a surface enhancer on an outer surface of the sleeve. In another, the method further comprises the step of performing a hardening process on the sleeve, thereby resulting in a hardened sleeve. In yet another, the method further comprises the step of providing an internal pipe positioned along an inner diameter of the at least one expanded portion, the internal pipe being expanded along with the at least one expanded portion such that an inner diameter of the drill pipe is substantially uniform throughout the drill pipe.

Another exemplary methodology of the present invention provides a method of using a drill pipe, the method comprising the steps of: (a) deploying the drill pipe down hole, the drill pipe comprising: a first joint located on an upper end of the drill pipe; a second joint located on a lower end of the drill pipe; a tubular body extending between the first and second joints, the tubular body comprising: an upper section extending beneath the first joint; a middle section extending beneath the upper section; and a lower section extending beneath the middle section, wherein a portion of the middle section of the tubular body comprises hardened material, while the first and second joints and the upper and lower sections of the drill pipe comprise a softer material, the hardened material being formed as a result of the middle section undergoing a hardening process, thereby resulting in a hardened middle section; and (b) performing a drilling operation utilizing the drill pipe. In another, the hardening process comprises at least one of a heat treatment, carburizing, nitriding, carbonitriding, flame hardening or chromizing process.

Another exemplary methodology of the present invention provides a method of using a drill pipe, the method comprising the steps of: (a) deploying the drill pipe down hole, the drill pipe comprising: a first joint located on an upper end of the drill pipe; a second joint located on a lower end of the drill pipe; a tubular body extending between the first and second joints, the tubular body comprising: an upper section extending beneath the first joint; a middle section extending beneath the upper section; and a lower section extending beneath the middle section, wherein the middle section of the tubular body comprises an expanded section in which an inner diameter of the expanded section is larger than an inner diameter of the upper and lower sections of the drill pipe; and (b) performing a drilling operation utilizing the drill pipe. In another, the drill pipe further comprises a sleeve surrounding the expanded section. In yet another, the expanded section has been hardened using a hardening process comprising at least one of a heat treatment, carburizing, nitriding, carbonitriding, flame hardening or chromizing process.

Although various embodiments and methodologies have been shown and described, the invention is not limited to such embodiments and methodologies and will be understood to include all modifications and variations as would be apparent to one skilled in the art. For example, downhole requirements may not necessitate use of a hardening process, expansion, and sleeve application in a single drill pipe. Rather, one or more methods may be utilized for any given section of drill pipe 10. Also, it may not be necessary, or desired, to apply surface enhancement 16 to sleeve 20. Additionally, a sleeve could be applied to a drill pipe without performing any hardening process on the tubular. Moreover, the buckle and wear resistant technology described herein may be applied to tubulars and downhole tools other than drill pipe as would be understood by one ordinarily skilled in the art having the benefit of this disclosure. Therefore, it should be understood that the invention is not intended to be limited to the particular forms disclosed. Rather, the intention is to cover all modifications, equivalents and alternatives falling within the spirit and scope of the invention as defined by the appended claims.

What we claim is:

1. A drill pipe comprising:

a first joint located on an upper end of the drill pipe;

a second joint located on a lower end of the drill pipe, wherein the first and second joints have a first outer diameter;

a tubular body having an original inner diameter and an original outer diameter, wherein the original outer diameter is less than the first outer diameter of the first and second joints, and the tubular body is formed from an original material and extends between the first and second joints, the tubular body comprising:

an upper section extending beneath the first joint and having the original outer diameter and the original inner diameter;

a middle section extending beneath the upper section; and a lower section extending beneath the middle section and having the original outer diameter and the original inner diameter, wherein the middle section of the tubular body has a second outer diameter greater than the original outer diameter and less than the first outer diameter of the first and second joints, the middle section has a second inner diameter greater than the original inner diameter, the middle section comprises a hardened material resulting from heat treating the original material, and the upper and lower sections of the tubular body comprise the original material.

2. A drill pipe as defined in claim 1, wherein heat treating the original material comprises heat quenching and tempering the original material.

3. A drill pipe as defined in claim 1, further comprising a surface enhancer on an outer surface of the hardened material on the middle section.

4. A drill pipe as defined in claim 3, wherein the surface enhancer is at least one of a friction-reducing material or an abrasion-resistant material.

5. A drill pipe as defined in claim 1, wherein the tubular body comprises a plurality of the upper, middle, and lower sections.

6. A method of using a drill pipe, the method comprising the steps of:

(a) deploying the drill pipe down hole, the drill pipe comprising:

a first joint located on an upper end of the drill pipe;

a second joint located on a lower end of the drill pipe, wherein the first and second joints have a first outer diameter;

a tubular body having an original inner diameter and an original outer diameter, wherein the original outer diameter is less than the first outer diameter of the first and second joints, and the tubular body is formed from an original material and extends between the first and second joints, the tubular body comprising:

an upper section extending beneath the first joint;

a middle section extending beneath the upper section; and a lower section extending beneath the middle section, wherein the middle section of the tubular body has a second outer diameter greater than the original outer diameter and less than the first outer diameter of the first and second joints, the middle section has a second inner diameter greater than the original inner diameter, the middle section comprises a hardened material resulting from a heat treatment applied to the original material, while the first and second joints and the upper and lower sections of the tubular body comprise the original material; and (b) performing a drilling operation utilizing the drill pipe.

7. A method as defined in claim 6, wherein the heat treatment comprises heat quenching and tempering.

8. A method of using a drill pipe, the method comprising the steps of:

(a) deploying the drill pipe down hole, the drill pipe comprising:

a first joint located on an upper end of the drill pipe;

a second joint located on a lower end of the drill pipe, wherein the first and second joints have a first outer diameter;

a unitary tubular body extending between the first and second joints, wherein the unitary tubular body has an original inner diameter and an original outer diameter, the original outer diameter is less than the first outer diameter of the first and second joints, and the unitary tubular body is formed from an original material, the tubular body comprising:

a first section extending from the first joint;

a second section extending from the second joint; and an expanded section extending between the first and second sections, the expanded section resulting from a tubular expansion of the tubular body having the original inner diameter and original outer diameter, the expanded section having a second outer diameter greater than the original outer diameter and less than the first outer diameter of the first and second joints, the expanded section having a second inner diameter greater than the original inner diameter, and wherein the expanded section comprises a hardened material resulting from a heat treatment of the original material; and (b) performing a drilling operation utilizing the drill pipe.

9. A method as defined in claim 8, wherein the drill pipe further comprises a sleeve surrounding the expanded section.

10. A method as defined in claim 8, further comprising a surface enhancer on an outer surface of the expanded section.

11. A method as defined in claim 8, wherein the expanded section comprises a non-circular shape.

12. A method as defined in claim 8, further comprising a plurality of expanded sections.

13. A method as defined in claim 9, wherein the sleeve comprises a surface enhancer on an outer surface of the sleeve.

14. A method as defined in claim 13, wherein the surface enhancer comprises at least one of a friction-reducing or abrasion-resistant material.

15. A method as defined in claim 9, wherein an outer surface of the sleeve comprises a hardened material which has undergone a hardening process.

16. A method as defined in claim 8, further comprising an internal pipe positioned along an inner surface of the expanded section, an inner diameter of the internal pipe being substantially flush with the original inner diameter.

17. A method as defined in claim 8, wherein the second outer diameter of the expanded section is expanded in a range between about 15% to about 20% from the original outer diameter of the tubular body.

18. A drill pipe as defined in claim 1, wherein the upper section provides a length to accommodate gripping of the tubular body formed from the original material during run-in.

19. A drill pipe as defined in claim 1, wherein the middle section has a length between about 5 ft to about 15 ft.

20. A drill pipe as defined in claim 2, wherein the heat quenching and tempering comprises:

heat quenching at an austenitizing temperature of about 1700 degrees Fahrenheit; and tempering at a tempering temperature of about 1050 degrees Fahrenheit.

21. A method as defined in claim 6, wherein deploying the drill pipe comprises engaging the upper section of the tubular body with a gripping tool.

22. A method as defined in claim 21, wherein the upper section provides a length to accommodate the gripping tool so that the gripping tool engages the tubular body formed from the original material.

23. A method as defined in claim 6, wherein the drill pipe further comprises a surface enhancer on an outer surface of the hardened material on the middle section.

24. A method as defined in claim 23, wherein the surface enhancer is at least one of a friction-reducing material or an abrasion-resistant material.

25. A method as defined in claim 6, wherein the tubular body comprises a plurality of upper, middle and lower sections.

26. A method as defined in claim 6, wherein the middle section has a length between about 5 ft to about 15 ft.

27. A method as defined in claim 6, wherein the heat treatment comprises heat quenching at an austenitizing temperature of about 1700 degrees Fahrenheit; and tempering at a tempering temperature of about 1050 degrees Fahrenheit.

28. A drill pipe comprising:

a first joint located on a first end of the drill pipe;

a second joint located on a second end of the drill pipe, wherein the first and second joints have a first outer diameter;

a unitary tubular body having an original inner diameter and an original outer diameter, wherein the original outer diameter is less than the first outer diameter of the first and second joints, and wherein the unitary tubular body is formed from an original material and extends between the first and second joints, the tubular body comprising:

a first section extending from the first joint;

a second section extending from the second joint; and an expanded section extending between the first and second sections, the expanded section having a second outer diameter greater than the original outer diameter and less than the first outer diameter of the first and second joints, the expanded section having a second inner diameter greater than the original inner diameter, the expanded section resulting from a tubular expansion of the tubular body having the original inner diameter and original outer diameter, and wherein the expanded section comprises a hardened material resulting from a heat treatment of the original material.

29. The drill pipe of claim 28, wherein the first section and the second section provide a length to accommodate gripping of the tubular body formed from the original material during run-in.

30. The drill pipe of claim 28, wherein the second outer diameter of the expanded section is expanded in a range between about 15% to about 20% from the original outer diameter of the tubular body.

31. The drill pipe of claim 28, further comprising a surface enhancer on an outer surface of the expanded section.

32. The drill pipe of claim 31, wherein the surface enhancer is at least one of a friction-reducing material or an abrasion-resistant material.

33. The drill pipe of claim 28, wherein the tubular body comprises a plurality of first, second and expanded sections.

34. The drill pipe of claim 28, wherein the expanded section comprises a non-circular shape.

35. The drill pipe of claim 28, further comprising a sleeve fixed atop an outer surface of the expanded section.

36. The drill pipe of claim 35, wherein the sleeve comprises a surface enhancer on an outer surface of the sleeve.

37. The drill pipe of claim 36, wherein the surface enhancer comprises at least one of a friction-reducing material and an abrasion-resistant material.

38. The drill pipe of claim 35, wherein the outer surface of the sleeve comprises a hardened material which has undergone a hardening process.

39. The drill pipe of claim 28, further comprising an internal pipe positioned along an inner surface of the expanded section, an inner diameter of the internal pipe being substantially flush with the original inner diameter.

* * * * *